United States Patent [19]

Vermaat

[11] Patent Number: 4,884,798

[45] Date of Patent: Dec. 5, 1989

[54] COPY TURN AROUND MECHANISM FOR REPRODUCTION MACHINE

[75] Inventor: David Vermaat, Port Crane, N.Y.

[73] Assignee: Imagitek, Binghamton, N.Y.

[21] Appl. No.: 166,930

[22] Filed: Mar. 11, 1988

[51] Int. Cl.[4] ..... B65H 29/54

[52] U.S. Cl. ..... 271/307; 271/311; 271/184; 271/186

[58] Field of Search ..... 271/311, 312, 307, 303, 271/175, 176, 188, 184–186, 902, 207, 211

[56] References Cited

U.S. PATENT DOCUMENTS

| | | | |
|---|---|---|---|
| 4,080,159 | 3/1978 | Behun | 271/311 X |
| 4,156,524 | 5/1979 | Bar-on et al. | 271/311 |
| 4,220,323 | 9/1980 | Smith | 271/207 X |
| 4,364,657 | 12/1982 | Landa | 271/312 X |
| 4,575,069 | 3/1986 | Burkhart | 271/186 |
| 4,627,609 | 12/1986 | Höfer | 271/311 |
| 4,726,579 | 2/1988 | Kiba et al. | 271/902 X |

FOREIGN PATENT DOCUMENTS

| | | | |
|---|---|---|---|
| 56456 | 5/1981 | Japan | 271/186 |
| 72562 | 5/1982 | Japan | 271/186 |
| 143852 | 8/1984 | Japan | 271/186 |

*Primary Examiner*—Joseph J. Rolla
*Assistant Examiner*—David H. Bollinger
*Attorney, Agent, or Firm*—Kane, Dalsimer, Sullivan, Kurucz, Levy, Eisele and Richard

[57] ABSTRACT

A feed mechanism for a photocopy or similar machine directs the media, particularly wide-format media, into a receiving tray along a path which is substantially parallel to, but in the opposite direction of, the original media path. This allows for the removal of media from the front of the photocopy machine. With the drive mechanism in a first configuration, the leading edge of the media is fed directly into the receiving tray. Responsive to a position of the leading edge of the media, the drive mechanism changes to a second configuration so that the subsequent portion of the media is allowed to form a loop and to be delivered to a second receiving area.

7 Claims, 2 Drawing Sheets

COPY TURN AROUND MECHANISM FOR REPRODUCTION MACHINE

BACKGROUND OF THE INVENTION

The present invention relates to reproduction machines and in particular to a mechanical device which strips copy media from a heated roller surface within the machine and redirects the media toward the direction from which the media came.

Reproduction machines such as photocopiers traditionally are provided with a through-feed media system. That is, the paper, vellum or film on which the reproduction is formed enters and exits the copying section of the machine in line. As a result, the machine must be sufficiently long from front to rear to permit the media to collect. This is a particular problem in connection with large sized reproductions, such as engineering drawings since, the operation must feed the drawings and copy media from the front of the machine and retrieve the finished media from the rear of the machine. In addition to being inconvenient for the operator, this arrangement places space restrictions on where the machine can be placed since the rear of the machine must be accessible, thus precluding the machine being placed against a wall.

In view of the above, it is the principal object of the present invention to provide a highly reliable mechanism for directing a 180° turn in the path of copy media whereby to redirect the finished media to the feed area. A further object is to provide such a mechanism which is capable of handling a variety of media. A still further object is to provide such a mechanism which is relatively simple and low in cost.

SUMMARY OF THE INVENTION

The above and other beneficial objects and advantages are attained in accordance with the present invention by providing a mechanism which comprises a stripper finger apparatus which strips the media from a heated fuser roller. The media is then guided into the nip of an idler roller and a segmented drive roller. The first position of the idler roller is such that the media is directed to a receiving tray. The sensing of the lead edge of the media within the receiving tray activates an electromechanical means so as to swing the idler wheel into such a position as to direct the media outward causing the subsequent portion of the media to form a loop. The loop is continuously enlarged by the drive action of the high friction segmented roller until the entire length of media copy is exhausted and the trailing edge of the copy is allowed to fall into vertical alignment with a lower exit guide. Such falling motion may be assisted by gravity, blowing air, or both.

DETAILED DESCRIPTION OF THE PREFERRED EMBODIMENT

Figure 1:
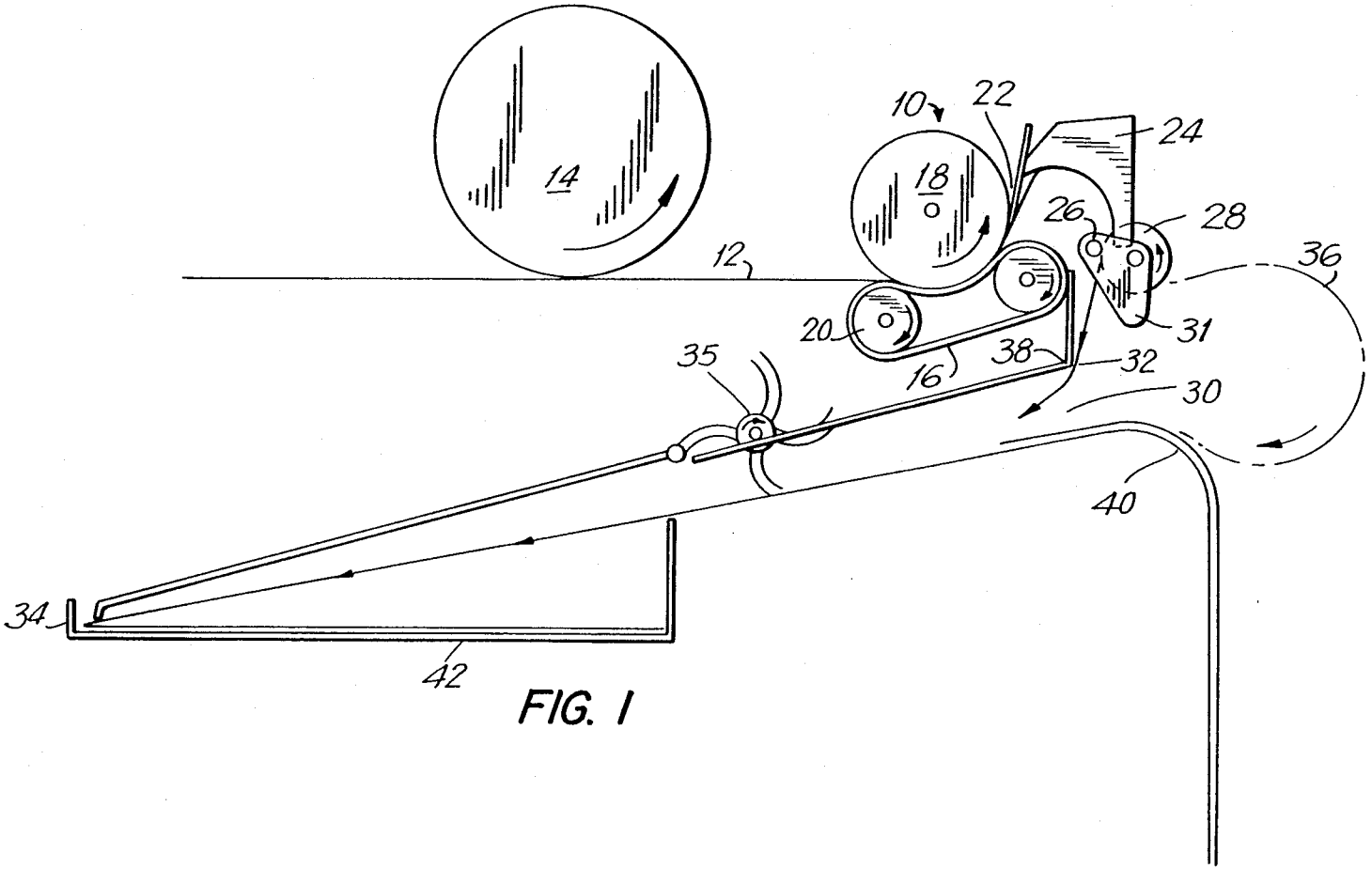
FIG. 1 is a side view, partly in elevation, of the mechanism of the present invention.

Referring now to the drawings in detail wherein like numbers represent like elements throughout the several views. FIG. 1 shows the apparatus 10 within the context of a photocopy machine. Media 12, such as paper, film or vellum is moved along a first paper path by drum 14 to the nip formed between belt 16 and fuser roller 18. Belt 16 is driven by two rollers 20. Elements 14–20 are not considered part of the present invention but rather comprise conventional parts of the environment in which the present apparatus 10 operates. The first element of apparatus 10 is stripper finger 22 which strips the media 12 from the fuser roller 18.

The stripper fingers 22 are fabricated from a low friction sheet stock material such as those commonly known by the tradenames Teflon, FEB, PFA, Halar or Kapton. This offers substantial improvement in performance and reliability over conventional metal finger strippers. Further, this offers a substantial economic advantage over the prior art design of molded fingers made of expensive high temperature plastics overcoated with low surface energy materials and their accompanying loading springs.

The stripper fingers 22 direct the media 12 to exit along a second path from guide 24 which further curves and directs the media 12 to the nip between idler roller 26 and segmented drive roller 28. As may be seen more particularly in FIGS. 2 and 3, idler roller 26 is journalled for rotation upon idler wheel swing assembly 31 which in turn pivots upon the axis of segmented drive roller 28. When the leading edge of the media 12 first contracts roller 26 and 28, the idler roller 26 and idler wheel swing assembly 31 are in the position shown in FIG. 2. The resulting nip geometry between rollers 26 and 28 directs the leading edge of media 12 toward receiving tray 30 along path 32. The leading edge of media 12 then abuts stop 34 at the end of receiving tray 30. As additional media 12 is fed by rollers 26 and 28, the leading edge of the media 12 contacts assist device 35. Assist device 35 may be a flap wheel, roller, or any similar device familiar to those skilled in the art. The assist device 35 nudges the leading edge of the media 12 further into receiving tray 30. Additionally, when the lead edge of media 12 reaches assist device 35, electromechanical means (not shown) is actuated which rotates idler wheel swing assembly 31 from its position shown in FIG. 2 to its position shown in FIG. 3. This alters the paper path so as to include a third path 36 rather than second path 32 thereby forming a loop as may be seen from the shape of path 36. The upper and lower guides 38 and 40 at the mouth of receiving tray 30 enlarge the loop as traced by path 36 as media 12 is fed by rollers 26 and 28 until the entire length of media 12 is exhausted and the trailing edge of media 12 is allowed to fall into vertical alignment with the lower guide 40 of the receiving tray 30. For particular long media 12, this results in a draping of the media over lower guide 40, resulting in a convenient placement for the user to stand in the original direction of travel of the media 12 and to remove the media 12 from the front of the apparatus 10.

The shape and location of upper and lower media guides 38 and 40 play an important role in controlling the media path.

Figure 2:
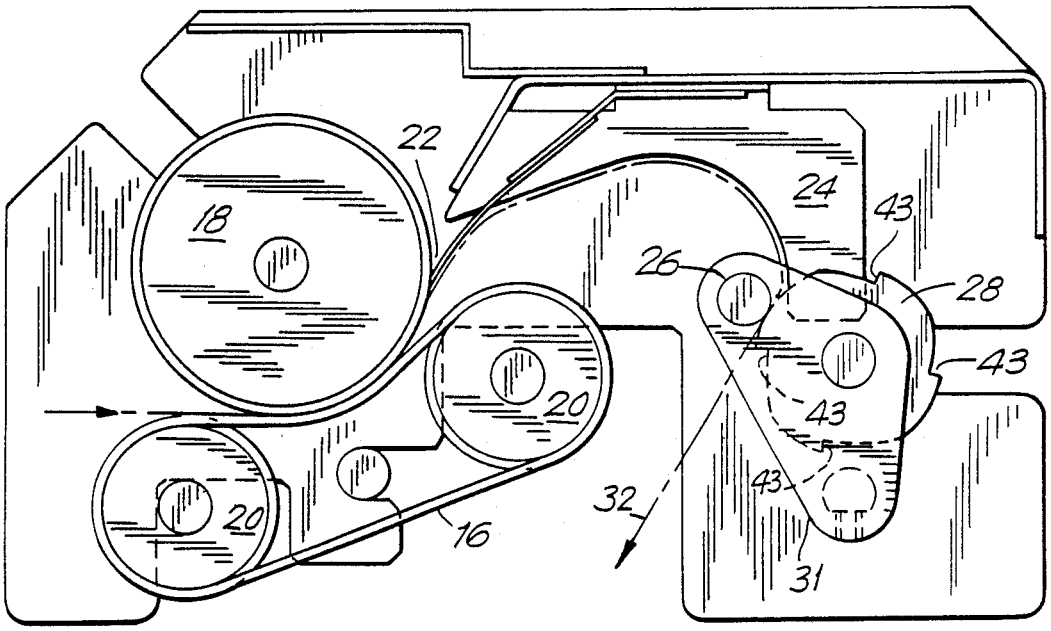
FIG. 2 is a more detailed view of the guide mechanism of the apparatus, with the idler wheel swing assembly in its first position to direct the media directly into the receiving tray; and, FIG. 3 is a more detailed view of the guide mechanism, with the idler wheel swing assembly in its second position to direct the media outward so as to form a loop.
Figure 3:
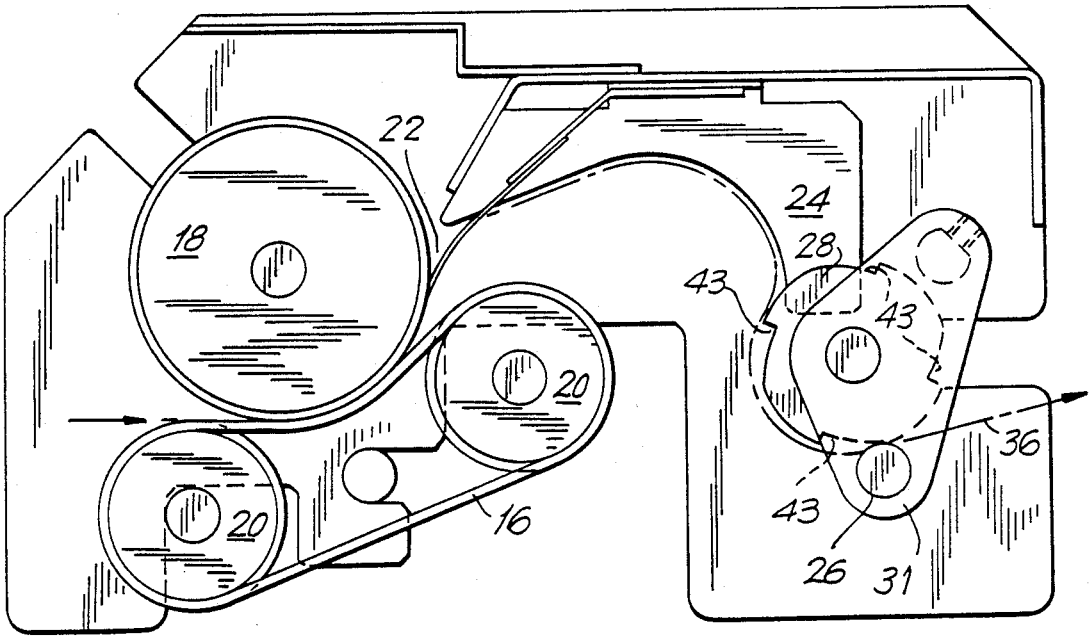

When all the media has passed through idler roller 26, electromechanical means (not shown) is actuated to rotate idler wheel swing assembly 31 back into the position shown in FIG. 2.

In the case of short media 12, the trail edge of media 12 falls into tray 42 within receiving tray 30 after abutting stop 34 preventing subsequent lead edges from catching on the previously stacked sheets' trail edges.

With media of certain lengths, extra assistance in driving the trailing edge out of the turnaround mechanism results in substantial improved reliability. To this end, one or more of the drive tires of the friction drive roller 28 may be notched 43 so as to entrap the trail edge of problem media and direct it out of the drive roller exit region by positive direct engagement.

It should be obvious to those skilled in the art that the above describes one general method for accomplishing said copy turnaround and that numerous similar configurations may be built employing all or part of the concepts described above. For example, the entire mechanism might be constructed without using the active turn mechanism by properly positioning the orientation of the nip formed between drive roller 28 and 26 along with proper formation and location of exit guides 38 and 40. Similarly, the second viewing area need not be in vertical alignment. It may instead be designed and located with any slope sufficient to ensure that gravity alone or in conjunction with other externally applied forces will reliably transport the trailing portion of the media completely out of the turnaround mechanism.

Thus, in accordance with the above, the aforementioned objects are effectively attained.

Having thus described the invention, what is claimed is:

1. A media feed mechanism for a reproduction machine comprising:

means for removing the media from a drum rotating in a direction which urges the media long a first path into the machine from a first side thereof;

guide means receiving the media from said removing means and directing the media to a drive means for driving the media;

wherein said drive means comprises an idler wheel and a drive wheel, said idler wheel being mounted on an idler wheel swing assembly which pivots about a rotation axis passing through said drive wheel, said swing assembly pivoting between a first position directing the leading edge of said media along a second path and a second position directing portions of said media to a third path;

wherein said drive means directs a leading edge of said media directly into a receiving means along said second path and directs a subsequent portion of said media along said third path so that said media forms a loop as the media travels to said receiving means whereby said media may be retrieved from said machine first side;

wherein said receiving means is disposed within said machine substantially parallel to and opposite from said first path and directed to said machine first side.

2. The invention in accordance with claim 1 wherein said drum is heated and comprises a fuser for said reproduction machine.

3. The invention in accordance with claim 1 wherein said removing means comprises a stripper finger formed of a plastic sheet material.

4. The invention in accordance with claim 3 wherein the plastic sheet material is selected from the group consisting of Teflon, FEP, PFA, Halar or Kapton or laminated composites.

5. The invention in accordance with claim 1 wherein pivoting of said idler wheel swing assembly between said first position and said second position is responsive to a position of a leading edge of the media.

6. The invention in accordance with claim 5 wherein said receiver means includes a stop for said media.

7. The invention in accordance with claim 1 wherein said drive wheel includes a notch to engage a trail edge of the media.

* * * * *